United States Patent [19]

Teague, Jr.

[11] 3,944,237

[45] Mar. 16, 1976

[54] SKI BINDING

[75] Inventor: Walter Dorwin Teague, Jr., Nyack, N.Y.

[73] Assignees: James Reed Morris, IV; Mary Carroll Sinclaire Morris; Halsted Morris; Katrina Morris, all of Denver, Colo. ; part interest to each

[22] Filed: Mar. 25, 1974

[21] Appl. No.: 454,719

[52] U.S. Cl. ..... 280/11.35 K

[51] Int. Cl.[2] ..... A63C 9/08

[58] Field of Search 280/11.35 K, 11.35 Y, 11.35 E, 280/11.35 D, 11.35 A, 11.35 N, 11.35 C, 11.35 H, 11.35 P, 11.35 F, 11.35 T, 11.35 R

[56] References Cited

UNITED STATES PATENTS

| | | | |
|---|---|---|---|
| 2,513,926 | 7/1950 | Erwin | 280/11.35 T |
| 2,573,955 | 11/1951 | Cubberley | 280/11.35 T |
| 3,244,431 | 4/1966 | Hatlapa | 280/11.35 K |
| 3,753,571 | 8/1973 | Gertsch et al. | 280/11.35 K |
| 3,838,866 | 10/1974 | DiAlessio et al. | 280/11.35 K |
| 3,845,964 | 11/1974 | Johnson | 280/11.35 K |
| 3,865,389 | 2/1975 | Delery | 280/11.35 K |
| 3,866,928 | 2/1975 | Gertsch et al. | 280/11.35 K |

FOREIGN PATENTS OR APPLICATIONS

| | | | |
|---|---|---|---|
| 268,951 | 2/1969 | Austria | 280/11.35 K |
| 1,926,108 | 11/1970 | Germany | 280/11.35 T |

*Primary Examiner*—Philip Goodman
*Assistant Examiner*—Milton L. Smith
*Attorney, Agent, or Firm*—Pasquale A. Razzano; Harold L. Stults

[57] ABSTRACT

A safety ski binding uses a rigid sole plate adapted to be releasably secured to a ski boot and having front and rear cam surfaces formed thereon for cooperation with toe and heel pieces that secure the sole plate, and thus the boot, to the ski. The toe piece and heel piece of the ski binding are both mounted on a ski plate or chassis secured to the ski in a predetermined position. The toe includes means defining a movable cam surface which engages the front cam surface of the sole plate, to releasably hold the plate on the ski, while the heel piece includes a resiliently biased cam that engages the rear cam surface of the sole plate when the sole plate is engaged in the toe piece and is flat against the ski, thereby to bias the sole plate towards the toe piece and normally maintain the front cam surface of the sole plate in engagement with the cam surface of the toe piece. The sole plate has a channel shaped configuration in section which is adapted to engage a pivot bar on the binding chassis to limit lateral movement of the sole plate to pivotal movement only while simultaneously permitting the sole plate to slide fore and aft on the ski.

39 Claims, 9 Drawing Figures

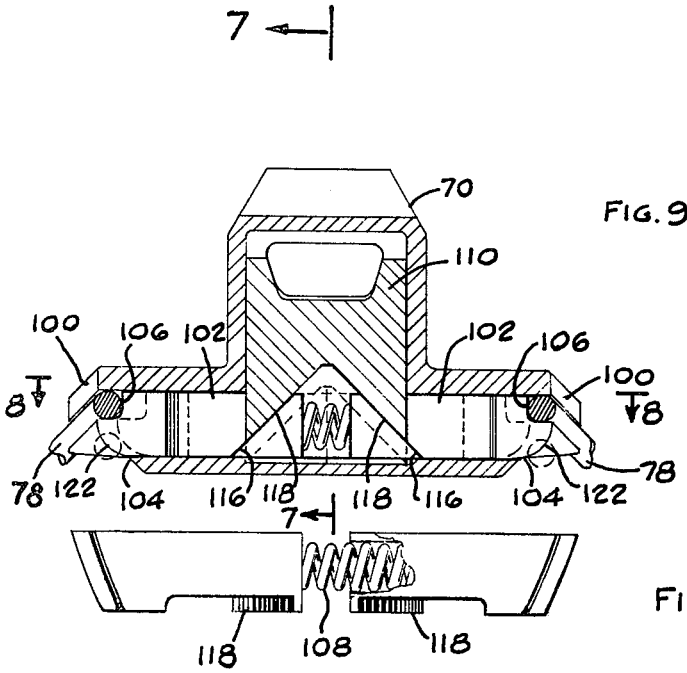
FIG. 6
FIG. 8
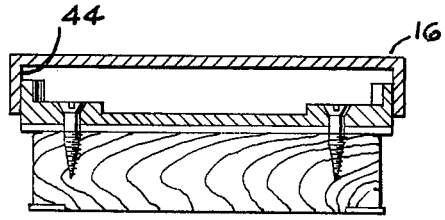
FIG. 9
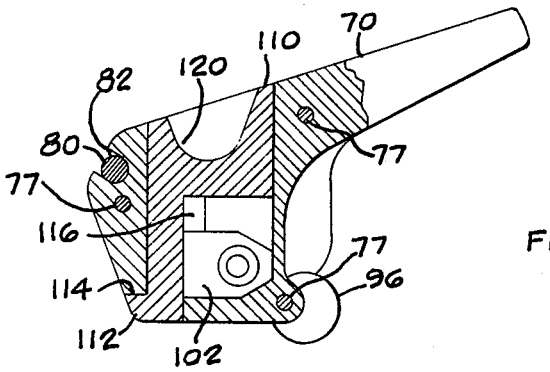
FIG. 7

SKI BINDING

The present invention relates to ski bindings and more particularly to an improved safety ski binding of the sole plate type.

With the expanding popularity of recreational downhill or Alpine skiing that has become evident in this country over recent years, there has been a complementary increase in demand for ski equipment which will decrease the incidence of skier injury and simultaneously be of high quality and durability. One of the most important items of Alpine downhill ski equipment, particularly from the injury standpoint, is the ski binding which secures the boot to the skis. Because of the increased popularity of skiing, and the increased number of non-expert skiers participating in the sport, there is a substantial need for a ski binding which will reduce the possibility of injury for the skiers. It is well recognized that the ski binding is an important factor in ski injuries and this of course, has lead to the development of the releasable ski binding which will permit boot and ski to separate in a fall. While numerous different designs of releasable ski bindings have been previously proposed for use in protecting the skier against injury during a fall, or by a ski striking an object, such previously proposed bindings all have certain inherent faults which may lead to injuries.

The typical binding consists solely of a toe iron or toe piece and a heel piece, both of which are secured to a ski and serve as clamps against the sole of the ski boot. Such bindings are usually designed to permit the release of the boot only in a vertical direction at the heel, and only in a lateral direction at the toe. In any case the purpose for such release bindings is to hold the skier's boot to the ski as rigidly as possible during all normal sking maneuvers which may be extremely violent in nature especially in the case of expert skiers and racers. In a fall, however, where the ski may bend or twist the skier's leg with high stresses, the binding must release the ski from the boot before injurious stresses build up in the skier's leg. Typically, because such previously proposed bindings are connected directly to the sole of the boot, substantial frictional forces also result during the release of the binding, which are difficult to overcome and often prevent release and cause injuries, even though the actual forces applied to the leg are relatively small. On the other hand, a release binding which releases the boot from the ski inadvertently during a normal violent skiing maneuver is just as dangerous as one which fails to release when required during a fall. Therefore the release characteristics of the binding must be sufficiently accurate to discriminate between normal skiing stresses and those which are potentially damaging.

Certain attempts have been made to overcome these problems by the provision of sole plate bindings, wherein a rigid plate is secured to a boot and then held to the ski by releasable toe and heel pieces. The object of such bindings is to reduce the friction involved where the ski binding is directly connected to the boot, but such previously proposed sole plate bindings also have serious problems in that the moment forces required for release often increase during release and/or cause premature release.

Accordingly, it is an object of the present invention to provide an improved safety release ski binding which is adapted to release a booth from the ski.

Another object of the present invention is to provide a sole plate ski binding which is relatively simple in construction yet durable in use.

A further object of the present invention is to provide a safety ski binding which will firmly hold the ski and boot together under normal skiing conditions, but which will readily release when an excessive force is applied to the ski or the boot, which would cause injury to the skier.

A still further object of the present invention is to provide a safety ski binding which is relatively inexpensive and simple to mount.

Yet another object of the present invention is to provide a toe piece for a sole plate ski binding which will securely clamp the toe of the boot to the sole plate.

Another object of the present invention is to provide a sole plate ski binding which will release reliably and accurately at torque thresholds in pitch and yaw which are preset according to the weight, experience and ability of the skier but to eliminate premature release as a result of normal violent skiing maneuvers.

A further object is to provide a safety ski binding in which the preset release torque levels are relatively unaffected by friction.

A further object is to provide a safety ski binding in which the stress on the skier's leg as a result of a simultaneous release in forward pitch and yaw will be no higher than the stress caused by either torque acting separately.

A further object is to provide a safety binding in which one preset adjustment determines the release torque values in forward pitch, backward pitch, and yaw.

A further object is to provide a safety ski binding in which the release level adjustment is relatively resistant to tampering and misadjustment.

A further object is to provide a safety binding which accepts sudden shock loads without premature release.

A further object is to provide a safety binding in which the release threshold in any mode is not affected by the presence of torques in other modes, or loads, or flexing of the ski.

A further object is to provide a safety binding which retains a rigid relationship between the boot and the ski up to the release torque threshold.

A further object is to provide a safety binding which has relatively little effect on the flexibility of the ski.

A further object is to provide a safety binding in which the runaway strap normally requires no attachment or detachment when stepping in or out of the ski.

A further object is to provide a plate type safety binding which is easier to attach to or detach from the ski boot.

A further object is to provide a safety binding which is light, inexpensive and rugged.

A further object is to provide a safety binding which is extremely simple to mount on the ski.

A further object is to provide a safety binding in which the mounting on the ski will not loosen during use.

In accordance with the one aspect of the present invention, a releasable ski binding for securing a ski boot to a ski, while permitting the release of the boot from the ski in all angles of release, includes a rigid sole plate having means for releasably securing the sole plate to the sole of the ski boot. The sole plate is constructed to cooperate with a ski plate or chassis mounted on the ski, which chassis includes pivot means mounted below the sole plate and located in a predetermined position, in order to limit lateral movement of the plate with respect to the longitudinal axis of the ski to pivotal movement about the fixed pivot point. This arrangement creates a fixed moment arm in the binding about which releases must take place, thereby preventing inadvertent release of the binding under small moments and controlling the moments applied to the ski boot or leg of the skier during a fall.

The provision of the pivot means of the binding and the other structural features thereof described hereinafter provides a release binding that will release as a result of certain torque moments only and not as a result of straight loads applied to the side or up or down on the skis. For convenience, the major moments can be described according to aircraft terminology as roll, pitch and yaw movements. These act around the X, Y, and Z axes respectively. While the present binding will release as a result of excess roll torques, there are relatively unimportant since, because of the narrow width of a normal ski, there is an insufficient moment arm to cause any serious torque. In any case, the present binding is designed to release reliably and accurately as a result of excess torques in the pitch and yaw modes and to be insensitive to straight loads whether up, down or sideways. The binding will release when the predetermined torque valve is reached in both forward or backward pitch and in yaw to left or right.

The sole plate has front and rear cam surfaces formed thereon. The toe piece, which is mounted on the ski plate or chassis (which in turn is mounted on the ski in a predetermined position) cooperates with the front cam surface of the sole plate to hold the plate against the ski. The toe piece includes a housing and an inverted frustroconical cam member rotatably mounted therein. The housing has an opening in its rear wall through which a portion of the cam member extends for engagement with the front cam surface of the sole plate. This front cam surface has a configuration which is generally complementary to the frusto-conical cam member so that the cam members serves to hold the front portion of the sole plate against the ski plate while permitting lateral movement of the cam surface of the sole plate, with reduced friction, particularly in the lateral direction.

The heel piece also mounted on the ski plate or chassis, in a fixed position adjacent the rear cam surface of the sole plate and includes a housing having a locking member slidably mounted therein and extending through the opening in the housing. Spring means are provided in the housing of the heel piece for resiliently biasing the locking member towards the toe piece and into engagement with the rear cam surface of the sole plate. This rear cam surface and the locking member also have generally complementary configurations so that the locking member holds the rear cam surface down against the ski, while permitting lateral and upward movement of the sole plate.

As a result of this construction, the sole plate and the attached boot can be released in numerous angles of release, particularly about the X, Y and Z axes under any force acting on the ski or boot which is sufficient to overcome the resilient biasing of the resilient means of the heel piece.

The above, and other objects features, and advantages of the present invention will be apparent in the following detailed description of an illustrative embodiment thereof, which is to be read in connection with the accompanying drawings wherein:

FIG. 6 is a sectional view taken along line 6—6 in FIG. 3 of the toe clamp used to clamp the toe of the ski booth to the sole plate;

FIG. 7 is a sectional view taken along line 7—7 of FIG. 6;

FIG. 8 is a sectional view taken along line 8—8 of FIG. 6; and

Figure 1:
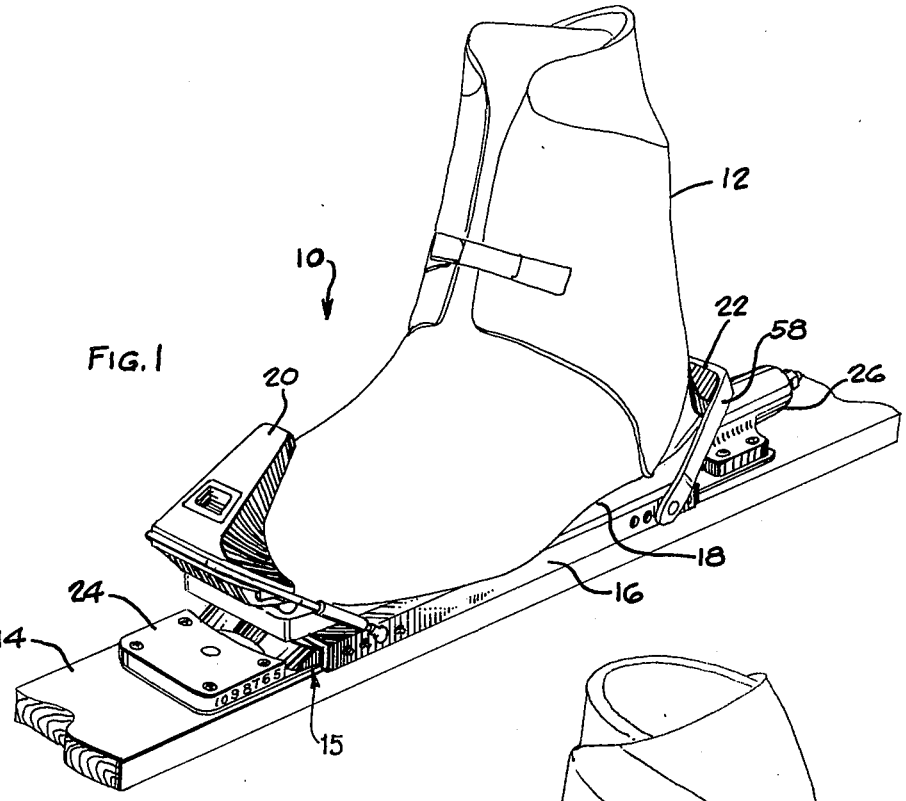
FIG. 1 is a front perspective view of a ski binding constructed in accordance with one embodiment of the present invention and shown mounted on a partially broken away ski.
Figure 4:
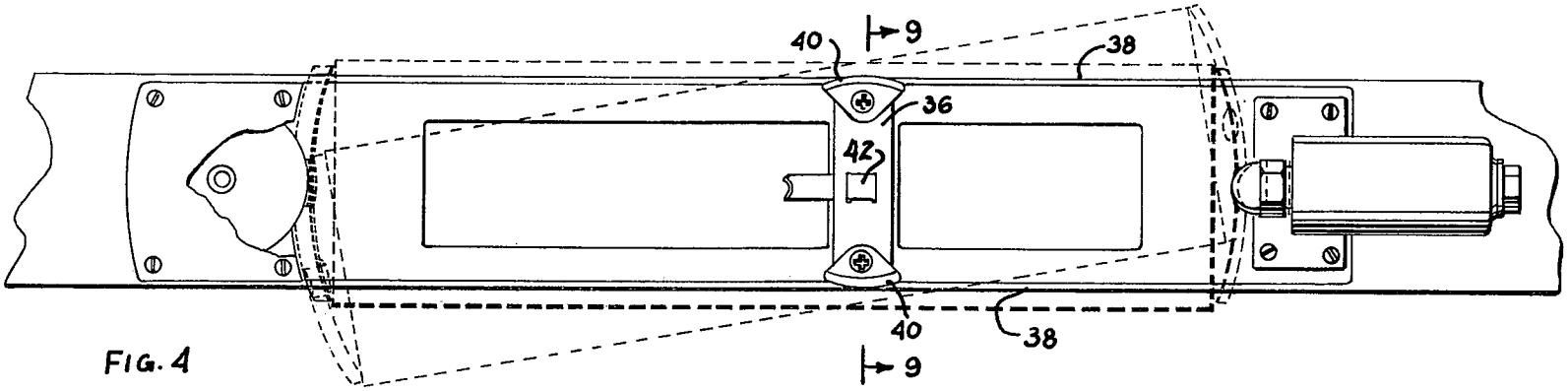
FIG. 4 is a plan view of the ski plate and heel and toe piece assembly of the ski binding of FIG. 3.

FIG. 9 is a sectional view taken along line 9—9 of FIG. 4. Referring now to the drawings in detail, and initially to FIG. 1 thereof, it will be seen that the ski binding 10, constructed in accordance with the present invention, is adapted to hold a conventional ski boot 12 in a fixed, but releasable, position on a ski 14. Ski binding 10 includes a sole plate 16 which is normally secured to the sole 18 of ski boot 12 by a toe clamp 20 and a heel retaining member 22. The sole plate 16 is preferably formed of metal, e.g. aluminum or steel, so as to form a rigid release plate which is not effected by dampness or temperature variations. This overcomes the problems of certain previously proposed ski bindings which are secured directly to the ski boot sole and thus affected by ski conditions because of shrinkage or expansion of the boot sole due to dampness or temperature changes.

Sole plate 16, in turn, secured to ski 14 by means of a ski plate or chassis assembly 15 which includes a thin flat plate 160 and a toe piece 24 and a heel piece 26 secured to the plate. This assembly is secured to the ski in the manner described hereinafter.

The heel piece contains a resilient spring or the like for clamping the sole plate between the top and heel pieces. Toe piece 24 and heel piece 26 are constructed as, described more fully hereinafter, to permit sole plate 16 to be released from clamping engagement therebetween upon the application of an excessive moment or torque to the ski, requiring release of the binding in order to protect the skier from injury.

Figure 2:
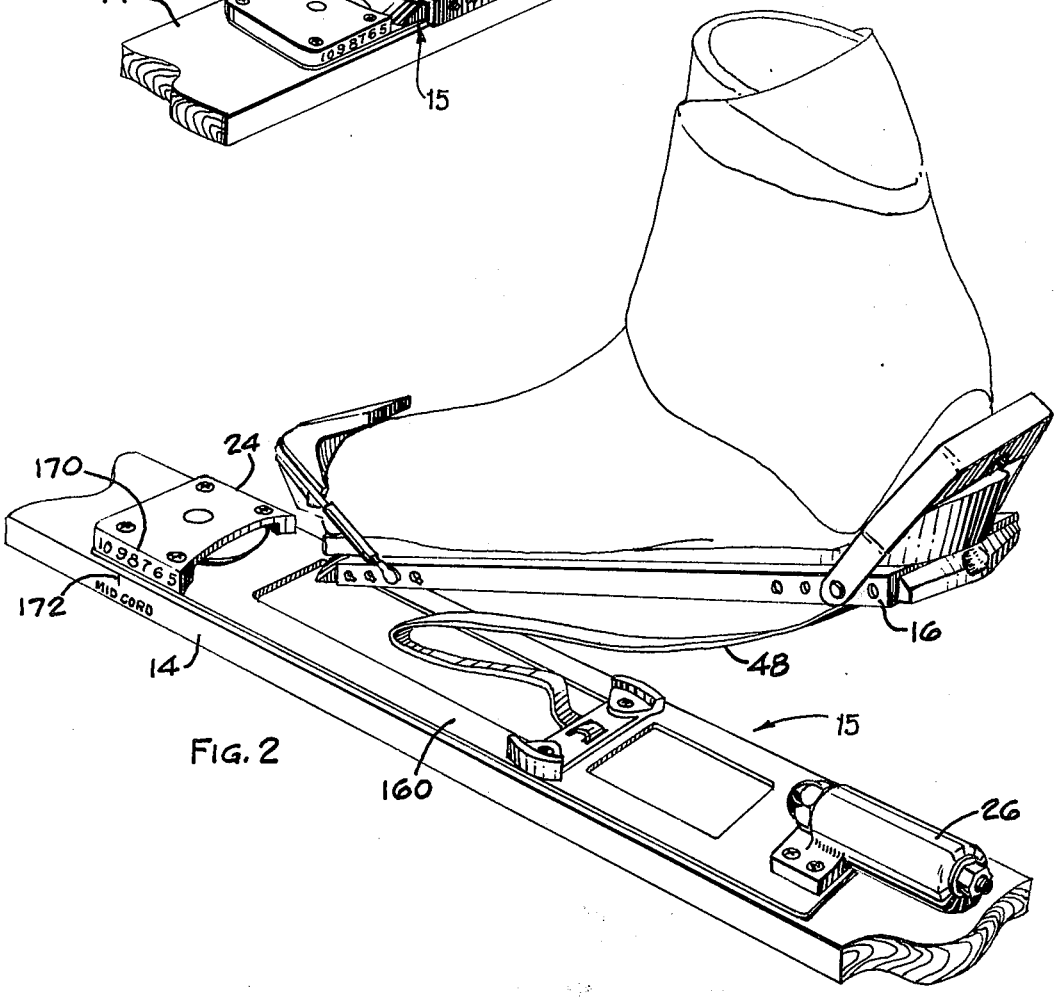
FIG. 2 is a perspective view of the ski binding of FIG. 1, illustrating the manner in which the sole plate is inserted into the binding and is released therefrom.
Figure 3:
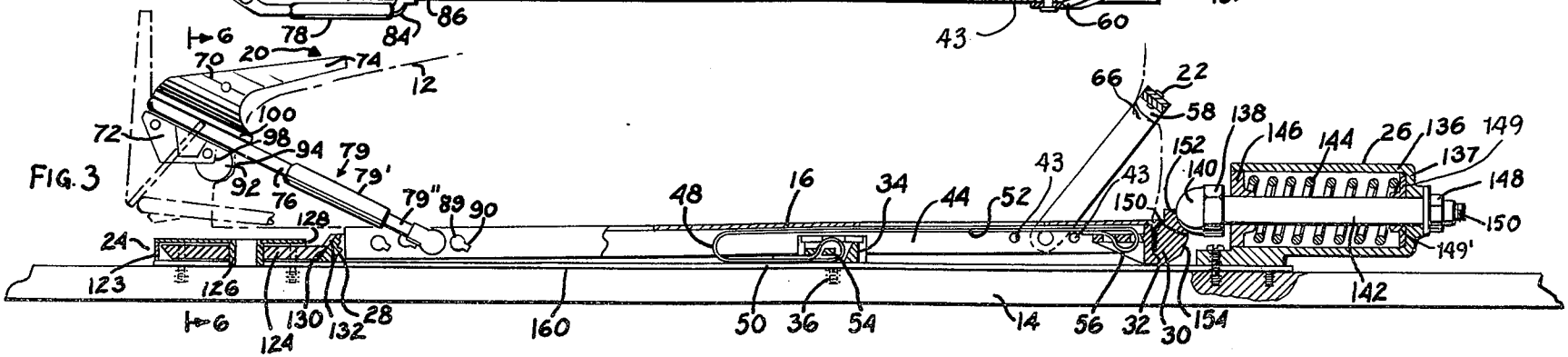
FIG. 3 is an enlarged side elevational view, partly in section and with parts broken away, of the ski binding shown in FIG. 1.

Referring more specifically to FIGS. 2, 3 and 9 of the drawing, it will be seen that sole plate 16 has a generally channel shaped cross section, laterally of the ski, and has front and rear cam members 28, 30 mounted thereon. These cam members are secured to the channel shaped sole plate 16 in any convenient manner, as for example by screws 32 or the like. The channel shaped configuration of sole plate 16 accommodates extensions of the cam members 28, 30 (see FIG. 3) within the sole plate below the sole of the boot and out of engagement therewith; thereby to allow more convenient securement of the cam members to the sole plate. These extensions support the sole plate on the ski plate and thus directly support the boot sole. As a result the rigidity of the boot sole is utilized in conjunction with the sole plate so that the sole plate can be made lighter in weight.

Preferably the cam members 28, 30 are formed of a plastic self-lubricating material, which is relatively rigid and unaffected by temperature changes or moisture. These cam members cooperate with the toe and heel pieces 24, 26 to retain the sole plate 16 therebetween under normal skiing conditions. They also reduce friction in the binding during a lateral or twisting release because of the low friction forces between the self-lubricating cams and the metal ski plate 160.

The channel shaped configuration of sole plate 16 allows for cooperation of the sole plate and a pivot member 34 which is mounted on the ski plate 160 in any convenient manner. Pivot means 34 (as seen in FIGS. 4 and 9) consists of an elongated bar that extends across the width of the ski to positions adjacent the ski edges or sides 38. The ends 40 of bar 34 are curved and form sections of a continuous body of revolution, i.e., they form opposite sections of a cylinder having a central vertical axis of revolution 42 located substantially in alignment with and perpendicular to the longitudinal axis of the ski. The exterior surfaces 40 at the ends of bar 34 cooperate with the internal surfaces 44 of the legs in the U-shaped channel sole plate 16 to limit lateral movement of the sole plate with respect to the ski. More specifically, the provision of the pivot bar 36 insures that the lateral movement of the sole plate with respect to the ski during release can only occur by rotation of the sole plate about axis 42, while still allowing the sole plate to move or slide longitudinally and vertically with respect to ski plate 160 in order to allow release in upward or twisting motions. In this manner the ski boot will not released by direct lateral motion of the ski as such movement is prevented by bar 34. Such movement is often present in violent skiing maneuvers but does not cause injury, however, previously proposed bindings will cause inadvertent release under these conditions. With the present invention on the other hand, since lateral release is limited to pivotal movement the binding will release only at a predetermined moment force as defined by the moment arm of the sole plate as fixed by pivot bar 34 and by the cam configurations of cam surfaces 28, 30. Thus the moments applied to the ski boot and skier's leg during a fall are controlled so that the skier will not be subjected to erratic twisting forces or moments during such release.

Sole plate 16 also is adapted to accommodate a novel run away safety strap structure. More specifically, the ski binding 10 is provided with a run away strap 48, formed of a flexible shape retaining and inelastic material, such as a light fiberglass/plastic material or nylon strapping having two flat arms 50, 52 located in a superimposed relation. The end 54 of strap 48 is secured in any convenient manner to pivot bar 34, while the opposite end 56 of the run away strap is secured to the cam member 30 at the rear of the sole plate. As seen in FIG. 3, the ends of the straps are folded over upon themselves through slots in bar 34 and cam 30, with the overlapped portions being secured together by an adhesive, rivet or the like. By this arrangement, as seen in FIG. 2, when sole plate 16 is released from between the toe and heel pieces 24, 26, plate 16 is secured to the ski 14 by the safety strap 48. As a result it is not possible for the skier to loose the ski or for a ski to "run away" upon release of the binding during a fall. Moreover, because the safety strap is formed of a material which retains its shape and automatically returns to its folded configuration as shown in FIG. 2, it does not interfere with the reinsertion of the sole plate into the ski binding after a fall. The safety strap in this construction also prevents inadvertent loss of the sole plate since the sole plate can never truly be separated from the ski during storage of the skis. Finally, because of this construction the safety strap is short and secured to the ski adjacent its center with the result that injurious "windmilling" of the loose ski during a fumbling fall is avoided.

As mentioned above, ski boot 12 is secured to sole plate 16 by a toe clamp 20 and a heel retention member 22. The latter consists of a generally U-shaped frame member 58 having legs 60 (see FIG. 5) which are pivotally secured to the side walls 44 of the sole plate adjacent the rear thereof. The bight portion 62 of frame member 58 has a pad 64 formed of a plastic material secured thereto in any convenient manner for engaging the rear groove 66 of the ski boot 12. The configuration of pad 64 is such that it has inclined surfaces which engage the boot and center it in the frame member 58 on ski plate 15. In use, the skier initially places his boot on sole plate 16, while it is mounted in toe and heel pieces 24, 26 and pivots frame member 58 to permit pad 64 to enter groove 56 in the boot heel and center the boot heel in the binding. Thereafter, the skier operates toe clamp 20 to secure the boot to the sole plate.

Toe clamp 20 consists of a lever 70 which has a generally L-shaped configuration including a lower arm 72 and a lever arm 74 located in a generally angular relationship with respect to one another. Lever 70 provides an over-the-center type clamping arrangement in cooperation with a link member 76 for securing the toe of the boot to sole plate 16. The lever is preferably formed from two identical plastic halves secured together by three rivets 77, (FIG. 7). 7).

Figure 5:
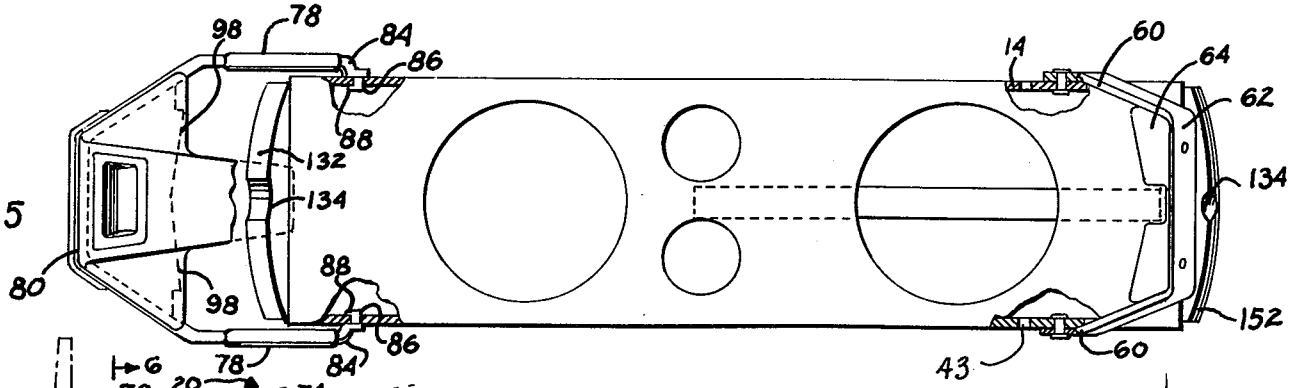
FIG. 5 is a plan view showing the sole plate of the binding as mounted in the ski plate assembly between the toe and heel piece.

Link 76 is a generally U-shaped member formed of a rigid material such as metal or the like, which is pivotally mounted in the side walls 44 of the sole plate 16, as seen in FIG. 5. The link includes a pair of legs 78 and a bight portion 80 which is pivotally mounted in lever 70. This pivotal mounting is accomplished, as seen most clearly in FIG. 7, by providing the exterior surface of lever 70 with a groove 82 in its front face, which groove has a slightly smaller diameter than that of bight portion 80. In this manner the bight portion 80 is clampingly held in groove 82, but pivotal movement is permitted. In this connection it is noted that lever 70 is preferably formed of a slightly resilient plastic material so as to resiliently accommodate the bight portion 80 of the link therein.

The free ends 84 of legs 78 have key members 86 formed thereon which consist of generally cylindrical rods having protuberances or keys 88 extending therefrom. These keys are received in apertures 89 formed in the side wall 44 of sole plate 14. The apertures 89 each have a configuration which is complementary to that of key members 86, and include extensions 90 which are adapted to the receive keys 88. However, as will be seen from FIGS. 3 and 5, the aperture portions 90 extend in a direction which is 180° opposite to the direction of the keys 88 when the toe clamp is positioned on ski boot 12. This arrangement prevents inadvertent removal of the ends of link 76 from the sole plate when the binding is in use. In addition a plurality of spaced apertures 89 are provided along the forward postion of plate 16, so that the position of link 76 along plate 16 can be adjusted to accommodate different size boots between the toe clamp 20 and the heel retaining member 22.

It is noted that the amount of tension provided by link 76 can be adjusted, in accordance with the present invention, by providing arms 78 with adjusting collar mechanisms 79. More particularly, arms 78 are provided with the threaded collars 79' which are rotatably mounted on grooves in the ends of arms 78. Threaded extensions 79'' of arms 78 are integrally formed with key members 86 and are threadably received within collars 79'. Accordingly, if the skier desires to increase the retention force of toe clamp 70, he simply rotates collar 79' in the appropriate direction to shorten the effective length of the legs 78 of links 76.

The lower arm portion 72 of lever 70 includes a free edge 92 which is adapted to be engaged in the groove 94 formed at the front of the sole of all ski boots. This free edge portion 92 provides a pivot edge for lever 70 and is formed with a curved surface 96. This surface is defined by a pair of generally conically shaped surface sections 98 (see FIG. 5), respectively formed on the two lever sections and located with their apices adjacent each other along the central axis of the lever. By providing the conically shaped sections in this manner, not only is a curved pivot surface provided, but also the angularly related surfaces tend to center the toe of the ski boot 12 in toe clamp 20.

The position of the free pivot end 92 of the lower arm 72 is a critical feature of the present invention in that it is located with respect to the groove 82 in the lever so as to always be below the level of legs 78 in link 76 when the clamp 20 is in its clamping position. This relative arrangement, of the free edge 96, in particular its central axis 98, with respect to legs 78 provides the over-the-center type clamp action in the lever. That, is as will be appreciated in FIG. 3, when lever 70 is in its closed position (shown in solid lines), link 76 will produce a pulling force on the lever tending to rotate the lever in a clockwise direction towards the ski boot, thereby urging the pivot end 92 of the lever into groove 94 and holding it thereagainst the ski boot. The clamping action of link 76 is limited, in accordance with the present invention, by the configuration of lever 70. That is, the lever is provided with a pair of stop flanges 100 formed along its side edges (see FIG. 6) which are located to be above the legs 78 of link 76. Thus, the pivotal movement of the lever 70 in a clockwise direction is limited by these stop flanges upon their engagement against the legs of the link. Therefore, the lever cannot be rotated further than its position shown in FIG. 3. The position of stop flanges 100 is selected to be located at a predetermined position with respect to link 76 so that the link produces a maximum clamping force against the ski boot. It is noted that by locating stop flanges 100 in this manner, link 76 will be abutted by the stop flanges in a position wherein the link is located above the central axis 98 of pivot edge 92, irregardless of which of the pairs of apertures 88 the ends of the links are mounted in.

Initially, when the binding is not in use, lever 70 is in a position such as shown in dotted lines in FIG. 3 and the skier simply places the boot on the sole plate 16 (which is normally held in position between toe piece 24 and heel piece 26) with the heel of this boot in the retaining member 22. He then pivots lever 70 in a clockwise direction (as seen in FIG. 3) to engage the free end 92 thereof in the groove 94 of the toe of his boot, and continues rotation of the lever until it reaches its limited position as defined by flanges 100.

In order to prevent the inadvertent opening of lever 70 in a counter-clockwise direction, the lever is provided with a safety locking mechanism which prevents counter-clockwise motion of the lever once it is in its proper clamping position, unless it is released intentionally by the skier. This safety locking mechanism consists of a pair of stop bars 102 which are slidably mounted in lever 70 (see FIGS. 6 and 7) and which extend through apertures 104 in the sides of the lever. These stop members have retention grooves or notches 106 formed in their free ends which are adapted to partially surround the legs 78 to link 76 when the lever 70 is in its closed position.

Stop members 102 are normally biased outwardly by a coil spring 108 (see FIG. 8) but are retained within the lever 70 by a latch member 110. The latter is freely mounted within lever 70 in a vertical direction (see FIG. 7), but cannot be removed therefrom. Thus latch 110 has an abutment shoulder 112 which engages against the bottom surface 114 of lever 70 to limit vertical movement of the latch. Latch 110 also includes angularly related cam surfaces 116 which engage complementary cam surfaces 118 formed in stop members 102. These complementary surfaces 116, 118 limit downward movement of the latch 110 in lever 70. Moreover, the cooperating surfaces 116, 118 permit retraction of the stop members 102 when the skier desires to release toe clamp 20.

More specifically, latch member 110 is exposed through the top surface of lever 70 (see FIG. 7) and has a well 120 formed therein which is adapted to receive the tip of a ski pole. Thus, when the skier desires to release lever 70 he inserts the tip of the ski pole in recess 120 and pushes latch member 110 downwardly. Such downward movement of the latch 110 causes the surfaces 116 of the latch to engage the surfaces 118 of stop members 102, and urges the stop members inwardly against spring 108, thereby to release the engagement of arms 78 in notches 106. Thus, the lower arm portion of the arm 72 of the lever is permitted to move upwardly between legs 78 of link 76 in a counter-clockwise motion of the lever 70. Continued downward pressure on latch 110 will cause counter-clockwise motion of the lever due to the location of the recess 120 with respect to the pivot surface 96, so that the lever is automatically rotated in the release direction by the skier, without the need for the skier bending over to physically open the toe clamp. On the other hand, when the lever 70 is rotated from its dotted line position in FIG. 3 to its solid line position, the stop members 102 engage arms 78 and are cammed inwardly by the arms until the arms engage stop flanges 110, at which point the stops 102 are free to move outwardly under the influence of spring 108. For this purpose the exterior surfaces 122 of the stop members are provided with a curved cam shaped configuration.

The toe piece 24 which retains the forward end portion of sole plate 16 on ski 14 includes a housing 123 which is secured to ski plate 15 in any convenient manner. For example, the toe piece 24 and heel piece 26 can be secured to the plate by an adhesive in proper relative positions by the manufacturer; then the entire assembly is secured to the ski by bolts 36 or the like by the installer as described hereinafter. Preferably housing 123 is of a hollow construction and has a generally frustro-conical cam member 124 rotatably mounted therein on a post 126 or the like. The rear end 128 of housing 123 has an opening therein through which a portion of the cam member 124 is exposed. It is noted that cam 124 is in an inverted position so that its cam surface 130 faces rearwardly and outwardly with respect to the housing 123.

Cam surface 130 is adapted to cooperate with the cam surface 132 of the front cam member 28 on sole plate 16. Cam member 28 (as seen in FIG. 5) has a central recess 134 in its cam surface 132 which is located generally on the central longitudinal axis of the sole plate. This recess 134 is engaged with the surface of cam member 124 to locate the sole plate 16 in its proper position with respect to the toe piece. The remainder of the cam surface 132 tapers away from the recess 134 to permit rotational movement of the sole plate about pivot plate 34 during release. Moreover, cam surface 132 is generally complementary to cam surface 130 of cam member 124 so that rearward motion of the sole plate 16 is permitted, as is upward and rearward motion thereof during twisting or other moment type releases. It is noted that the top wall of housing 123 reinforces cam member 124 in an upwardly release at the toe preventing any bending of the cam member. In addition, the housing, adjacent the opening therein, is curved as seen in FIG. 5 to permit free pivotal movement of sole plate 16.

The sole plate 16 is held against cam member 124 by heel piece 26. The heel piece includes a generally cylindrical housing 136 in which plunger 138 is slidably mounted. The plunger includes a locking head 140 mounted on a stem 142 which extends through housing 136 and is surrounded by a coiled compression spring 144. The latter acts against the rear wall 137 of housing 136 and an abutment plate 146 which is slidable within housing 136. Stem 142 is slidable within the rear wall 137 of housing 136 so that plunger 138 can be urged inwardly of the housing. Outward movement of locking head 140 (towards the left in FIG. 3) is limited by the provision of a nut 148 on the threaded end 150 of stem 148.

The amount of force applied to sole plate 16 by spring 144 is adjusted at the time the binding is mounted on the ski and in such a way as to avoid tampering with the adjustment. More specifically, the binding is provided with one or more annular shims 149 which are placed in housing 136 adjacent its rear wall behind the bearing plug 149'. The number and thickness of the shims is selected in accordance with the weight and skill of the person using the binding to compress spring 144 to the extent necessary to produce the required bias force in the binding. In this connection the purpose of nut 148 is not for adjusting the binding, but rather for simply taking up end play in the binding. That is, the nut is simply adjusted until the plate 16 does not move in the toe and heel pieces, with the principal adjustment being with shims 149.

Locking head 140 is adapted to engage the cam surface 152 of rear cam member 30 on sole plate 16. Preferably locking head 140 has a generally semi-spherical configuration which cooperates with the generally concave configuration of cam surface 152. That cam surface also has a recess 134 formed therein, located along the longitudinal axis of the sole plate, so as to locate the rear of the sole plate with respect to the heel piece. Recess 134 has a generally concave configuration whose configuration is selected to produce a predetermined force in cooperation with head 140 and spring 144. This force is effected by the angle of cam surface 152 at the release point or transition point 158 in the cam. That is, the greater the angle adjacent transition point 158 the greater the force will be in order to permit release of the binding. The rear cam member 30 of the sole plate also has a lower cam surface 154 which extends downwardly and away from the heel piece (as seen in FIG. 3) so that upon upward movement of the heel an initial increased force is applied to the cam member by spring 144, as the cam member 30 moves upwardly, thereby tending to hold the sole plate in position to prevent undesired release at low forces. Ultimately, at transition 158, between cam surfaces 152 and 154, the pressure of spring 144 is released so that the sole plate is released from the heel unit.

The recesses 134 in the cams 28, 30 center the sole plate in the binding and serve to cam the sole plate back into proper centered position under small shock forces during skiing and to allow slight displacement of the plate, up to about 5°, with automatic return of the plate, thereby to prevent inadvertent release of the sole plate under low forces applied to the ski, such as when skiing over moguls or bumps.

By the construction of the toe and heel pieces 24, 26 of the present invention it will be appreciated that spring 144 in the heel piece provides all of the clamping force used to retain the sole plate 16 between the toe and heel pieces and controls the exact moment values at which the binding will release in the three important release modes of yaw, pitch and roll. Moreover, it also will be appreciated that the construction of these elements permits release of the sole plate in all substantial angles of release above the level of the ski surface. Thus, for example, upon the application of an upward force to the boot, i.e. a rearward pitch movement, the mating engagement of cam surfaces 130, 132 will cam the sole plate 16 rearwardly, against locking head 140, thereby compressing spring 144 and permitting the sole plate to be released at the toe. This rearward movement is of course, permitted by the pivot bar 34 which permits longitudinal movement of the sole plate. Similarly, on a twisting movement applied to the sole plate 16, the front cam member 124 will permit relatively free lateral movement of the forward end of the sole plate while the rearward movement imparted to the plate because of the engagement of cam surfaces 130, 132 will compress spring 144 to permit the upward and lateral release. The angle of the cam surface 124, plus the spring force in heel piece 26, will determine the exact value at which release will occur.

With respect to twisting release of the sole plate, it is noted that the pivot bar 34 is located in a predetermined position along the ski (and on ski plate 160) between the toe and heel pieces in order to be generally in alignment with the tibia of the leg of a skier in the ski binding. In this manner, the pivotal motion of the sole plate during release is in alignment with the leg of the skier so that the amount of twisting moment on the leg is limited. Still further, the provision of a rotatable cam member in the toe piece 24 substantially reduces friction in the binding since in a release having a lateral component the cam member 124 will rotate in the housing. As a result, the problems of previously proposed bindings wherein the front of the sole plate must move against a fixed toe retention member, thereby creating a substantial friction, is eliminated.

As mentioned, toe piece 24, heel piece 26 and pivot bar 36 are all mounted on a chassis or ski plate 160.

These elements can be secured to the plate in any convenient manner as for example by an epoxy adhesive. The whole assembly is then secured to the ski by bolts 36 when the binding is installed. In this connection, it is contemplated that the lower surface of plate 160 can be coated with a pressure sensitive adhesive protected by a paper layer after manufacture. When the ski binding is then installed the paper is torn away to expose the adhesive and then the plate is placed in the proper position on the ski as described below.

In addition to providing a relatively safe ski binding, the structure of the present invention also permits convenient mounting of the binding on the ski. As is well known, it is normally preferred to mount the toe piece of the ski binding in a position on the ski such that the ball of the foot on the ski is located in predetermined position with respect to the mid-chord point of the ski, which is located in the well known manner and marked on the side of the ski by a line or another indicia. With previous bindings, the installer initially locates the ski boot to be used with a particular set of skis with respect to the mid-chord point, and then locates the toe piece with respect to the toe of the ski boot. However, in accordance with the present invention a more convenient mounting system is provided, simply by inscribing or marking indicia on the side wall 170 of housing 123 representing various ski boot sizes within a particular range.

Since the dimensions of the housing 123, cam 124, and sole plate 16, are known, and since the distance from the cam 124 to heel retainer 24 is also known, it will be appreciated that by mounting housing 122 in a particular position with respect to the mid-chord 170 on the side of the ski, then the distance between the mid-chord mark and the ball of any ski boot mounted on sole plate 16 will be known. Accordingly, the installer can simply place the mid-chord mark 172 in alignment with the indicia on the side wall 170 of housing 123, representative of the ski boot size to be used with the ski and then secures the assembly 15 to the ski by placing the plate 160 with its adhesive back against the ski. The installer then drills holes in the ski through the holes provided in the assembly and thence screws the assembly in with the screws 36. Since the pressure of spring 144 is previously adjusted with shims 149 the binding is now completely ready for use. If any adjustment of the ski boot with respect to the toe piece is desired by the skier he can move frame member 58 from the center openings to the front or rear pair of openings 43 in the sole plate.

Accordingly, it will be appreciated that a relatively simple ski binding is provided which is economical in construction and highly convenient in use.

As will be appreciated from the above detailed description, the binding consists of two major assemblies, the sole plate with its boot attachment system and the ski plate assembly which is attached to the ski. The sole plate snaps into the ski plate assembly and is held in place by the forward revolving cam and the spring biased head or plunger which engages the three-dimensional cam at the rear of the sole plate. The latter, as mentioned, is made in the form of an inverted channel with a flat or a ribbed upper surface. If desired, plastic wedges may be mounted on top of the sole plate to provide any desired degree of cant. The inside edges of the channel engage with the pivot block mounted on the ski plate, but the sole plate is allowed to move forward or backward as well as pivot. The sole plate may have a plurality of lightening apertures formed therein if desired.

Except after the binding releases the sole plate remains in position on the ski at all times. To attach the boot to the ski the heel of the boot is pushed back into the heel frame member. The forward toggle lever then locks the toe and in so doing the boot is pushed all the way down and back into place. The runaway strap which is normally concealed by the sole plate, attaches the rear of the sole plate to the front of the ski plate assembly near the mid-chord position of the ski and serves to eliminate "windmilling" in a fall.

In operation the sole plate remains firmly locked down to the ski under all maneuvers until the release torque threshold is reached in one or more of the three release modes of pitch, roll or yaw. The entire design of the present binding is based primarily on the principle that it will release as a result of torque moments but will not release as a result of safe-straight loads applied to the ski. Since injuries to skiers are the result of moments in the three principle modes, the binding is designed so as to be very accurate on releasing in these torque modes, but is insensitive to straight loads whether down, up or sideways along the pitch, yaw and roll axes.

Since one of the principal causes of inadvertent binding release is because of side loads on the boot, the pivot bar of the present invention is provided to insure release only as the result of torque and not direct load. The pivot, which is approximately in line with the center of the skier's leg, will effectively prevent side loads from affecting the binding. The center of the leg is the ideal position for this pivot since violent skiing maneuvers will not create a releasing torque. However, in the event of a fall in which the ski catches and rotates, the torque created will cause the sole plate to rotate around the pivot bar as the plunger is forced out of the rear cam. As mentioned, the spring load and the shape of the cam/plunger interface determine the torque level at which this rotation will commence. If this is only a very momentary shock the binding will be returned to the normal position by the spring action, but if it is sustained until approximately 5° of rotation takes place, the sole plate will free itself completely from the ski, except for the runaway strap.

In the case of a forward pitch type of release (such as might be caused by the skier running into a snow bank at high speed) the sole plate of the invention will rotate upward around the forward cam as a fulcrum. Again this release torque level is determined by the same spring and plunger/cam interface.

It is evident that a fall which involves a combination of the two above torque modes in normal bindings will result in very high combined stresses on the leg. However, in the present binding, by choosing the proper contour of the rear three-dimensional cam, the combined stress on the leg will be no higher than if the torques act individually. In the case of a rearward pitch accident, the angle of the forward cam is chosen so as to release at the proper relative torque threshhold. This cam angle can be between 27° and 45° (preferably41°) depending on what relative rear pitch release torque is desired. In this mode the entire sole plate is forced back against the spring and plunger force, which, together with cam angle determine the threshhold value.

In a yaw release, because of the recess in the conical front cam of the sole plate, the entire sole plate must move aft slightly. This load plus the rear three-dimensional shape and the spring load together determine the yaw release torque level. Due to the configuration of the yaw pivot bar, which is a narrow segment of a circle, as soon as any appreciable yaw angle is attained by the boot plate, the pivot disengages itself from the inner flanges of the boot plate channel.

In forward pitch the contour of the rear three-dimensional cam, the radius of the spring plunger, and the spring load determine the release torque. Note that by properly contouring the three-dimensional cam, any combination of relative release torques in yaw and forward pitch may be selected. Thus special cams may easily be molded or machined for individual preference for downhill, grand slalom, slalom, etc. The cam contour is preferably such that the binding will not start to move in forward pitch or yaw release until the release torque threshhold is reached. This characteristic is desirable since it maintains rigid control of the ski unless the danger torque threshhold is reached. It should also be noted that by properly contouring the three-dimensional cam, if forward pitch and yaw torques occur simultaneously, the combined stress on the leg bone can be limited to the stress due to either mode individually.

In general, the average skier and in fact the average ski shop mechanic is incapable of judging with any validity, the relative release torque magnitude in forward pitch, yaw, and after pitch. Bindings which permit individual adjustment of these values to each other, are an invitation to injury due to misadjustment. However, certain very experienced skiers may have some individual preferences in these ratios, and special cams should be provided as an extra item if desired. A hot-dogger, for instance, might want a higher rear pitch release torque, a very polished skier a relatively lower yaw release level, etc. In this connection, the present invention permits a choice of spring and shim combination in the spring plunger assembly that will match the release torque in the three modes to the weight, experience and ability of the skier. This system minimizes the possibility of improper adjustment by the skier.

After a release takes place, the sole plate is still attached to the skier's boot and is also attached to the ski by the runaway strap.

Due to the mounting of the strap the possibility of the flailing ski injuring the skier, i.e. injuries generally caused by the skier's head or face being lacerated by the flailing ski tip are minimized. With the present runaway strap geometry, the ski tip cannot reach this far except in the event of very unusual contortions.

To re-assemble the binding after a release, the skier first engages the forward cam, then forces the sole plate down into position in front of the rear plunger/spring.

Although an illustrative embodiment of the present invention has been described herein with reference to the accompanying drawings, it would be appreciated that various modifications and changes can be effective therein without departing from the scope or spirit of this invention.

What is claimed is:

1. A ski binding comprising a rigid sole plate including means for releasably securing the sole plate to the sole of a boot; said sole plate having front and rear cam surfaces thereon;

a toe piece member adapted to be mounted on a ski in a predetermined position and including means defining a movable cam surface for engaging said front cam surface of the sole plate to releasably hold said plate on the ski; and a heel plate adapted to be mounted on said ski in a fixed position adjacent the rear cam surface of the sole plate when the sole plate is engaged with said toe piece and including resiliently biased cam means for engaging said rear cam surface of the sole plate and for biasing said sole plate towards said toe piece thereby to normally maintain said front cam surface of the sole plate in engagement with said toe piece; said means defining a movable cam surface in said toe piece comprising a cam member rotatably mounted in said toe piece and adapted to rotate upon lateral movement of the sole plate with respect to the toe piece, thereby to reduce resistance to binding release in the lateral direction; and means adapted to be mounted on the ski between the toe and heel pieces for cooperating with said sole plate to define a limited pivot point for the sole plate with respect to the ski during release of the binding, said means defining a limited pivot point also permitting simultaneous longitudinal movement of the sole plate with respect to the ski whereby the sole plate can be released from the ski in a twisting fall with simultaneous longitudinal movement of the plate with respect to the ski and pivotal movement of the plate about the limited pivot point; and said toe piece comprising an enclosed housing having an open end through which said cam member projects for engagement with said front cam surface, said housing, cam member and said sole plate having fixed predetermined dimensions with respect to the direction of ski length, and said housing having a plurality of indicia thereon representative of various boot sizes, said indicia being located in predetermined positions on the housing selected in accordance with the dimensions of the housing, cam member and sole plate whereby the appropriate indicia for a selected boot size can be aligned with the mid-chord point of a ski to locate said housing on the ski in the desired position wherein the ball of the foot in a boot of the selected size will be located at a predetermined distance from the point of engagement of the cam member and the front cam of the sole plate.

2. The ski binding as defined in claim 1 including a thin ski plate mounted on said ski and said toe piece and heel piece being mounted on said ski plate in relatively fixed spaced positions to receive said sole plate therebetween on said ski plate.

3. The ski binding as defined in claim 1 including a thin ski plate mounted on said ski; said toe piece, heel piece and cooperating pivot means being mounted on said ski plate in relatively fixed spaced positions.

4. The ski binding as defined in claim 1 wherein one of said sole plate and means mounted on the ski defining said limited pivot point has an elongated slot formed therein bounded by a pair of straight side walls; and the other of said sole plate and means defining said limited pivot point comprises means for providing at least one pair of arcuate surfaces received within said slot when the sole plate is mounted on the ski between said toe and heel pieces; said arcuate surfaces limiting lateral movement of the sole plate with respect to the ski solely to pivotal movement about a vertical axis defined between said arcuate surfaces, while simultaneously permitting longitudinal movement of the sole plate with respect to the ski.

5. A ski binding comprising a rigid sole plate including means for releasably securing the sole plate to the sole of a boot; said sole plate having front and rear cam surfaces thereon;

a toe piece member adapted to be mounted on a ski in a predetermined position and including means defining a movable cam surface for engaging said front cam surface of the sole plate to releasably hold said plate on the ski; and a heel piece adapted to be mounted on said ski in a fixed position adjacent the rear cam surface of the sole plate when the sole plate is engaged with said toe piece and including resiliently biased cam means for engaging said rear surface of the sole plate and for biasing said sole plate towards said toe piece thereby to normally maintain said front cam surface of the sole plate in engagement with said toe piece; said means defining a movable cam surface in said toe piece comprising a cam member rotatably mounted in said toe piece and adapted to rotate upon lateral movement of the sole plate with respect to the toe piece, thereby to reduce resistance to binding release in the lateral direction; and means adapted to be mounted on the ski between the toe and heel pieces for cooperating with said sole plate to define a limited pivot point for the sole plate with respect to the ski during release of the binding while permitting longitudinal movement of the sole plate with respect to the ski; said sole plate being generally channel shaped in cross-section transversely of the ski, said channel shaped plate opening downwardly toward said ski; said means defining a pivot point comprising means for providing a pair of upright arcuate surfaces adjacent the upper edges of the ski and adapted to be received within said channel shaped plate; said arcuate surfaces limiting lateral movement of the sole plate with respect to the ski solely to pivotal movement about a vertical axis defined between said arcuate surfaces.

6. The ski binding as defined in claim 5 wherein said front cam surface of the sole plate and the cam surface of said cam member in the toe piece are generally complementary, the cam surface of said cam member providing a generally downwardly and forwardly inclined surface adapted to hold said front cam surface below it and the sole plate against the ski when the rear cam surface of the sole plate is engaged with said heel piece.

7. The ski binding as defined in claim 6 wherein said cam member comprises an inverted frustro-conical disk rotatably mounted in said toe piece.

8. The ski binding as defined in claim 5 wherein said pair of arcuate surfaces are located in predetermined positions with respect to said toe piece to locate said vertical axis generally in vertical alignment with the tibia of a leg in the boot.

9. The ski binding as defined in claim 5 wherein said front and rear cam surfaces on said sole plate have axially aligned central recessed cam surface portions for respective engagement with the cam surface of the toe piece and the cam means of the heel piece to normally hold said sole plate in a fixed position between said toe and heel pieces.

10. The ski binding as defined in claim 9 wherein said front and rear cam surfaces include cam sections extending laterally away from said recesses and towards said sole plate in controlled contours thereby to provide controlled release forces against the sole plate in cooperation with the resiliently biased cam means of the heel piece.

11. The ski binding as defined in claim 5 including a safety runaway strap secured between the ski and said sole plate.

12. The ski binding as defined in claim 10 wherein said runaway strap is formed of a flexible inelastic material having a flat folded configuration defining two straight flat sections located in superimposed relation to each other below the sole plate when the plate is positioned between said toe and heel pieces.

13. The ski binding as defined in claim 5 wherein said means for releasably securing the sole plate to the sole of a boot includes means defining an over-the-center-clamp for securing the toe portion of the boot to the sole plate.

14. The ski binding as defined in claim 13 wherein said means defining an over-the-center-clamp comprises a generally U-shaped link having a pair of spaced legs respectively secured to opposite sides of said sole plate and a bight portion extending between said legs; a generally L-shaped lever having two arms and being pivotally secured to the bight portion of said link between said arms, one of said arms having a pivot edge portion at the free end thereof adapted to engage the toe portion of the sole of the boot and the other of said arms comprising a lever arm located above the toe of the boot when the boot is secured to the sole plate; said bight portion of the link being secured to said lever at a predetermined location wherein the legs of the link are always located above the pivot edge portion of the lever when the boot is secured to the sole plate, thereby to clamp the toe of the boot to the plate.

15. The ski binding as defined in claim 14 wherein said sole plate has a plurality of aligned keyhole shaped apertures formed at opposite sides thereof and the free ends of the legs of said U-shaped link have key members formed therein which are complementary in configuration to said apertures, said key members having protuberances formed thereon which extend in a direction opposite to the complementary portions of said apertures when the lever is clamped to the boot.

16. A ski binding comprising a rigid sole plate including means for releasably securing the sole plate to the sole of a boot; said sole plate having front and rear cam surfaces thereon.

a toe piece member adapted to be mounted on a ski in a predetermined position and including means defining a movable cam surface for engaging said front cam surface of the sole plate to releasably hold said plate on the ski; and a heel piece adapted to be mounted on said ski in a fixed position adjacent the rear cam surface of the sole plate when the sole plate is engaged with said toe piece and including resiliently biased cam means for engaging said rear cam surface of the sole plate and for biasing said sole plate towards said toe piece thereby to normally maintain said front cam surface of the sole plate in engagement with said toe piece; said means defining a movable cam surface in said toe piece comprising a cam member rotatably mounted in said toe piece and adapted to rotate upon lateral movement of the sole plate with respect to the toe piece, thereby to reduce resistance to binding release in the lateral direction; said means for releasably securing the sole plate to the sole of a boot including means defining an over-the-center clamp for securing the toe portion of the boot to the sole plate; said means defining an over-the-center clamp comprising a generally U-shaped link having a pair of spaced legs respectively secured to opposite sides of said sole plate and a bight portion extending between said legs; a generally L-shaped lever having two arms and being pivotally secured to the bight portion of said link between said arms, one of said arms having a pivot edge portion at the feee end thereof adapted to engage the toe portion of the sole of the boot and the other of said arms comprising a lever arm located above the toe of the boot when the boot is secured to the sole plate; said bight portion of the link being secured to said lever at a predetermined location wherein the legs of the link are always located above the pivot edge portion of the lever when the boot is secured to the sole plate, thereby to clamp the toe of the boot to the plate; said pivot edge portion of the lever forming the only contact between lever and the boot and said lever including means integral therewith for engaging said link at a predetermined position for limiting pivotal movement of the lever with respect to the link in the clamping direction to the optimum clamping position of the lever, whereby the lever is maintained in the optimum clamping position independently of the type or size of boot mounted on the sole plate.

17. The ski binding as defined in claim 16 wherein said limiting means comprises abutment surfaces on said lever arm located to engage the legs of said link and limit pivotal movement of the lever with respect to the link beyond a predetermined position.

18. A ski binding comprising a rigid sole plate including means for releasably securing the sole plate to the sole of a boot; said sole plate having front and rear cam surfaces thereon;

a toe piece member adapted to be mounted on a ski in a predetermined position and including means defining a movable cam surface for engaging said front cam surface of the sole plate to releasably hold said plate on the ski; and a heel piece adapted to be mounted on said ski in a fixed position adjacent the rear cam surface of the sole plate when the sole plate is engaged with said toe piece and including resiliently biased cam means for engaging said rear cam surface of the sole plate and for biasing said sole plate towards said toe piece thereby to normally maintain said front cam surface of the sole plate in engagement with said toe piece; said means defining a movable cam surface in said toe piece comprising a cam member rotatably mounted in said toe piece and adapted to rotate upon lateral movement of the sole plate with respect to the toe piece, thereby to reduce resistance to binding release in the lateral direction;

said means for securing the sole plate to the sole of the boot including means defining an over-the-center clamp for securing the toe portion of the boot to the sole plate; said means defining an over-the-center clamp comprising a generally U-shaped link having a pair of spaced legs respectively secured to opposite sides of said sole plate and a bight portion extending between said legs; a generally L-shaped lever having two arms and being pivotally secured to the bight portion of said link between said arms, one of said arms having a pivot edge portion at the free end thereof adapted to engage the toe portion of the sole of the boot and the other of said arms comprising a lever arm located above the toe of the boot when the boot is secured to the sole plate; said bight portion of the link being secured to said lever at a predetermined location wherein the legs of the link are always located above the pivot edge portion of the lever when the boot is secured to the sole plate, thereby to clamp the toe of the boot to the plate; said lever including releasable means mounted solely within the lever for normally preventing pivotal movement of said lever in an opening direction away from said boot.

19. The ski binding as defined in claim 18 wherein said releasable means comprises means for normally preventing movement of said link with respect to said lever.

20. A ski binding comprising a rigid sole plate including means for releasably securing the sole plate to the sole of a boot; said sole plate having front and rear cam surfaces thereon;

a toe piece member adapted to be mounted on a ski in a predetermined position and including means defining a movable cam surface for engaging said front cam surface at the sole plate to releasably hold said plate on the ski; and a heel piece adapted to be mounted on said ski in a fixed position adjacent the rear cam surface of the sole plate when the sole plate is engaged with said toe piece and including resiliently biased cam means for engaging said rear cam surface of the sole plate and for biasing said sole plate towards said toe piece thereby to normally maintain said front cam surface of the sole plate in engagement with said toe piece; said means defining a movable cam surface in said toe piece comprising a cam member rotatably mounted in said toe piece and adapted to rotate upon lateral movement of the sole plate with respect to the toe piece, thereby to reduce resistance in binding release in the lateral direction;

said means for releasably securing the sole plate to the sole of a boot including means defining an over-the-center clamp for securing the toe portion of the boot to the sole plate; said means defining an over-the-center clamp comprising a generally U-shaped link having a pair of spaced legs respectively secured to opposite sides of said sole plate and a bight portion extending between said legs; a generally L-shaped lever having two arms and being pivotally secured to the bight portion of said link between said arms, one of said arms having a pivot edge portion at the free end thereof adapted to engage the toe portion of the sole of the boot and the other of said arms comprising a lever arm located above the toe of the boot when the boot is secured to the sole plate; said bight portion of the link being secured to said lever at a predetermined location wherein the legs of the link are always located above the pivot edge portion of the lever when the boot is secured to the sole plate, thereby to clamp the toe of the boot to the plate; and releasable means for normally preventing pivotal movement of said lever in an opening direction away from said boot; said releasable means comprising a pair of aligned stop members movably mounted in said lever and respectively extending below the legs of said link, means for biasing said stop members outwardly under said legs and means for limiting outward movement of said stop members under said legs thereby to normally prevent said legs from moving to a release position below the axis of rotation of the pivot edge of the lever.

21. The ski binding as defined in claim 20 wherein said limiting means and said stop means have cooperating cam guide surfaces formed thereon, said limiting means being slidable in said lever between first and second positions and said cam guide surfaces being constructed to cause retraction of said stop members as said limiting means is moved from its first to its second direction thereby to remove said stop members from below said legs of the link to permit movement of the lever in its opening direction.

22. The ski binding as defined in claim 21 wherein said limiting means is mounted in said lever for vertical sliding movement and is located forwardly of the axis of rotation of the pivot edge of the lever, with respect to the sole plate, whereby said lever may be engaged by a ski pole, depressed to move from its first to its second position to retract said stop members, and cause said lever to pivot to its open position.

23. A releasable safety ski binding for securing a ski boot to a ski while permitting release of the boot from the ski in a plurality of angles of release, said binding comprising, a rigid sole plate; means for releasably securing said sole plate to the sole of a boot; means adapted to be mounted on a ski for cooperating with said sole plate to limit lateral movement of the plate with respect to the longitudinal axis of the ski to pivotal movement about a fixed pivot point, while permitting free longitudinal and vertical movement of the sole plate with respect to the ski; said sole plate having front and rear cam surfaces thereon;

a toe piece adapted to be mounted on the ski in a predetermined position, said toe piece including a housing and an inverted frustro-conical cam member rotatably mounted therein, said housing having an opening therein through which a portion of said cam member extends for engagement with the front cam surface of the sole plate, said front cam surface having a configuration which is generally complementary to said frustro-conical cam member whereby the cam member serves to hold the front portion of the sole plate against the ski while permitting lateral and upward movement of the front cam surface of the sole plate; and a heel piece adapted to be mounted on said ski in a fixed position adjacent the rear cam surface of the sole plate when the sole plate is engaged with said toe piece; said heel piece including a housing, a locking member slidably mounted in said housing and extending through an opening therein and spring means in said housing for resiliently biasing said locking member towards said toe piece and into engagement with said rear cam surface of the sole plate; said rear cam surface and said locking member having generally complementary configurations whereby the locking member holds the rear cam surface down against the ski while permitting lateral and upward movement of the sole plate, whereby said sole plate and the attached boot can be released in any angle of release from said toe and heel pieces under any force acting on the ski and boot which is sufficient to overcome the resilient bias of said resilient means;

said means cooperating with said sole plate to limit lateral movement of the plate to pivotal movement about a fixed pivot point being located between and independently of said toe and heel pieces, generally in vertical alignment with the tibia of a leg in the boot and permitting simultaneous longitudinal movement of the sole plate with respect to the ski whereby the sole plate can be released from the ski in a twisting fall with simultaneous longitudinal movement of the plate with respect to the ski and pivotal movement of the plate about said limited pivot point.

24. The ski binding as defined in claim 23 including a thin ski plate mounted on said ski, said toe and heel pieces and said cooperating pivot means being mounted on said plate in fixed predetermined spaced positions with respect to each other.

25. The ski binding as defined in claim 23 wherein one of said sole plate and means mounted on the ski defining said limited pivot point has an elongated slot formed therein bounded by a pair of straight side walls; and the other of said sole plate and means defining said limited pivot point comprises means for providing at least one pair of arcuate surfaces received within said slot when the sole plate is mounted on the ski between said toe and heel pieces; said arcuate surfaces limiting lateral movement of the sole plate with respect to the ski solely to pivotal movement about a vertical axis defined between said arcuate surfaces, while simultaneously permitting longitudinal movement of the sole plate with respect to the ski.

26. A releasable safety ski binding for securing a ski boot to a ski while permitting release of the boot from the ski in a plurality of angles of release, said binding comprising, a rigid sole plate; means for releasably securing said sole plate to the sole of a boot; means adapted to be mounted on a ski for cooperating with said sole plate to limit lateral movement of the plate with respect to the longitudinal axis of the ski to pivotal movement about a fixed pivot point, while permitting free longitudinal and vertical movement of the sole plate with respect to the ski; said sole plate having front and rear cam surfaces thereon;

a toe piece adapted to be mounted on the ski in a predetermined position, said toe piece including a housing and a inverted frustro-conical cam member rotatably mounted therein, said housing having an opening therein through which a portion of said cam member extends for engagement with the front cam surface of the sole plate, said front cam surface having a configuration which is generally complementary to said frustro-conical cam member whereby the cam member serves to hold the front portion of the sole plate against the ski while permitting lateral and upward movement of the front cam surface of the sole plate; and a heel piece adapted to be mounted on said ski in a fixed position adjacent the rear cam surface of the sole plate when the sole plate is engaged with said toe piece; said heel piece including a housing, a locking member slidably mounted in said housing and extending through an opening therein and spring means in said housing for resiliently biasing said locking member towards said toe piece and into engagement with said rear cam surface of the sole plate; said rear cam surface and said locking member having generally complementary configurations whereby the locking member holds the rear cam surface down against the ski while permitting lateral and upward movement of the sole plate, whereby said sole plate and the attached boot can be released in any angle of release from said toe and heel pieces under any force acting on the ski and boot which is sufficient to overcome the resilient bias of said resilient means; said sole plate being generally channel shaped in cross-section, transversely of the ski, said channel shaped plate opening downwardly towards said ski, and said means for limiting lateral movement of said plate with respect to said ski to pivotal movement comprising a rigid bar adapted to be mounted on said ski between said toe and heel pieces and having a pair of upright laterally spaced arcuate surfaces adjacent the edges of the ski and received in said channel shaped sole plate adjacent the respective legs thereof, said arcuate surfaces defining arcuate portions of a common body of revolution and having a common central axis whereby said bar limits lateral movement of the sole plate in a plane parallel to the ski to pivotal movement about said central axis.

27. The ski binding as defined in claim 26 wherein said bar is located in predetermined position with respect to said toe piece, thereby to locate said central axis in generally vertical alignment with the tibia of a leg in the boot.

28. The ski binding as defined in claim 26 wherein said front and rear cam surfaces on said sole plate have axially aligned central recessed cam surface portions for respective engagement with the cam surface of the toe piece and the cam means of the heel piece to normally hold said sole plate in a fixed position between said toe and heel pieces.

29. The ski binding as defined in claim 28 wherein said front and rear cam surfaces include cam sections extending laterally away from said recesses and towards said sole plate in controlled contours thereby to provide controlled release forces against the sole plate in cooperation with the resiliently biased cam means of the heel piece.

30. The ski binding as defined in claim 29 including a safety runaway strap secured between the ski plate and said sole plate.

31. The ski binding as defined in claim 30 wherein said runaway strap is formed of a flexible inelastic material having a flat folded configuration defining two straight flat sections located in superimposed relation to each other below the sole plate when the plate is positioned between said toe and heel pieces.

32. The ski binding as defined in claim 30 wherein said means for releasably securing the sole plate to the sole of a boot includes means defining an over-the-center-clamp for securing the toe portion of the boot to the sole plate.

33. A toe clamp for securing a ski boot to a sole plate in a releasable ski binding, said toe clamp comprising a generally U-shaped link having a pair of spaced legs respectively secured to opposite sides of said sole plate and a bight portion extending between said legs; a generally L-shaped lever having two angularly related lever arms and being pivotally secured to the bight portion of said link, between said arms, one of said arms having a pivot edge portion at the free end thereof adapted to engage the toe portion of the sole of the ski boot and the other of said arms comprising a lever arm located above the toe of the boot when the boot is secured to the sole plate; said bight portion of the link being secured to the lever at a predetermined location wherein the legs of the link are always located above the pivot edge portion of the lever when the boot is secured to the sole plate of the lever thereby to provide an over-the-center action clamping the boot to the sole plate; said pivot edge portion of the lever forming the only contact between the lever and the boot, and said lever including integral means for engaging said link at a predetermined position for limiting pivotal movement of the lever with respect to the link in the clamping direction to the optimum clamping position of the lever, whereby the optimum clamping position of the lever is maintained independently of the type or size boot mounted on the sole plate.

34. The toe clamp as defined in claim 23 wherein said limiting means comprises abutment surfaces on said lever arm located to engage the legs of said link and limit pivotal movement of the lever with respect to the link beyond a predetermined position.

35. A toe clamp for securing a ski boot to a sole plate in a releasable ski binding, said toe clamp comprising a generally U-shaped link having a pair of spaced legs respectively secured to opposite sides of said sole plate and a bight portion extending between said legs; a generally L-shaped lever having two angularly related lever arms and being pivotally secured to the bight portion of said link, between said arms, one of said arms having a pivot edge portion at the free end thereof adapted to engage the toe portion of the sole of the ski boot and the other of said arms comprising a lever arm located above the toe of the boot when the boot is secured to the sole plate; said bight portion of the link being secured to the lever at a predetermined location wherein the legs of the link are always located above the pivot edge portion of the lever when the boot is secured to the sole plate of the lever thereby to provide an over-the-center action clamping the boot to the sole plate; said lever including integral means for limiting pivotal movement of the lever with respect to the link in the clamping direction to the optimum clamping position of the lever; and releasable means mounted solely within the lever for normally preventing pivotal movement of said lever in an opening direction away from said boot.

36. A toe clamp for securing a ski boot to a sole plate in a releasable ski binding, said toe clamp comprising a generally U-shaped link having a pair of spaced legs respectively secured to opposite sides of said sole plate and a bight portion extending between said legs; a generally L-shaped lever having two angularly related lever arms and being pivotally secured to the bight portion of said link, between said arms, one of said arms having a pivot edge portion at the free end thereof adapted to engage the toe portion of the sole of the ski boot and the other of said arms comprising a lever arm located above the toe of the boot when the boot is secured to the sole plate; said bight portion of the link being secured to the lever at a predetermined location wherein the legs of the link are always located above the pivot edge portion of the lever when the boot is secured to the sole plate of the lever thereby to provide an over-the-center action clamping the boot to the sole plate; said lever including integral means for limiting pivotal movement of the lever with respect to the link in the clamping direction to the optimum clamping position of the lever; and releasable means for normally preventing pivotal movement of said lever in an opening direction away from said boot; said releasable means comprising a pair of aligned stop members slidably mounted in said lever and respectively extending below the legs of the link to hold said legs between the stop members and said integral limiting means; means for biasing said stop members outwardly under said legs; and means for limiting outward movement of said stop members under said legs thereby to normally prevent said legs from moving to a release position below the axis of rotation of the pivot edge of the lever.

37. The toe clamp as defined in claim 36 wherein said limiting means and said stop means have cooperating cam guide surfaces formed thereon, said limiting means being slidable in said lever between first and second positions and said cam guide surfaces being constructed to cause retraction of said stop members as said limiting means is moved from its first to its second direction thereby to remove said stop members from below said legs of the link to permit movement of the lever in its opening direction.

38. The toe clamp as defined in claim 37 wherein said limiting means is mounted in said lever for vertical sliding movement and is located forwardly of the axis of rotation of the pivot edge of the lever, with respect to the sole plate, whereby said lever may be engaged by a ski pole, depressed to move from its first to its second position to retract said stop members, and cause said lever to pivot to its open position.

39. The toe clamp as defined in claim 36 wherein said pivot edge of the lever has a predetermined curved surface configuration consisting of two generally conically shaped segments with the apex of each segment abutting each other adjacent the center of the lever, thereby to center the ski boot in the toe piece.

* * * * *